US007717657B2

(12) United States Patent
Clarke

(10) Patent No.: US 7,717,657 B2
(45) Date of Patent: May 18, 2010

(54) METHOD FOR TYING PACKAGED GOODS TO A PALLET

(75) Inventor: Richard Clarke, Cape Town (ZA)

(73) Assignee: Clarke Technologies (PTY) Ltd., Nerina, Durbanville (ZA)

( * ) Notice: Subject to any disclaimer, the term of this patent is extended or adjusted under 35 U.S.C. 154(b) by 121 days.

(21) Appl. No.: 11/660,502

(22) PCT Filed: Aug. 19, 2005

(86) PCT No.: PCT/ZA2005/000120

§ 371 (c)(1),
(2), (4) Date: Feb. 20, 2007

(87) PCT Pub. No.: WO2006/024050

PCT Pub. Date: Mar. 2, 2006

(65) Prior Publication Data

US 2008/0019788 A1 Jan. 24, 2008

(30) Foreign Application Priority Data

Aug. 27, 2004 (ZA) ..... 2004/6826

(51) Int. Cl.
*B60P 7/08* (2006.01)

(52) U.S. Cl. ..... 410/98; 410/99; 410/46; 410/85; 410/96; 410/41; 410/34

(58) Field of Classification Search ..... 410/46, 410/85, 96, 97, 98, 99, 100, 106, 41, 32, 410/34, 110, 116, 155; 206/453, 586, 597; 108/55.1, 55.5, 57.2; 248/499
See application file for complete search history.

(56) References Cited

U.S. PATENT DOCUMENTS

| | | | | |
|---|---|---|---|---|
| 1,607,711 | A | | 11/1926 | Walker |
| 2,160,235 | A | | 5/1939 | Slusar |
| 3,601,866 | A | * | 8/1971 | Odin |
| 5,636,951 | A | * | 6/1997 | Long et al. ..... 410/85 |

FOREIGN PATENT DOCUMENTS

| | | |
|---|---|---|
| FR | 1 586 294 | 2/1970 |
| GB | 945 199 | 12/1963 |
| WO | WO 00/37330 | 6/2000 |

* cited by examiner

*Primary Examiner*—Stephen Gordon
(74) *Attorney, Agent, or Firm*—Young & Thompson

(57) ABSTRACT

The method makes use of four top corner plates (3), four bottom corner plates (4) and five centre plates (5). Each plate (3, 4 and 5) has a number of holes (2) that accept and retain swivel connectors (1) and adjustable connector straps (8) that mechanically connect the corner plates (3) and (4) and centre plates (5) and in this manner allow for the even restraining of the goods (7) packed on the pallet (14).

7 Claims, 9 Drawing Sheets

A. A.

B. B.

METHOD FOR TYING PACKAGED GOODS TO A PALLET

FIELD OF THE INVENTION

This invention relates to a method and means for securing packaged goods and in particular to a method of tying packaged goods to a pallet and to apparatus used in the method.

The term goods used in this specification will cover any product or goods whether fresh, frozen or canned food stuffs or any other product (commercial or otherwise) that needs to be held in a certain position or that is actually being transported or moved and needs to be restrained during the transportation period.

The term pallet used in this specification means an entity that goods are placed on for the purposes of holding goods for storage or transporting goods and includes all pallets of whatever shape, size or material.

BACKGROUND TO THE INVENTION

Existing methods for preventing movement of goods such as plastic-sheet wrapping, net wrapping and even taping are not successful and much damage is caused by shifting loads. In the case of refrigerated goods, the plastic-sheet wrapping method restricts airflow through the goods causing hot-spots within the load and resulting in temperature damage to goods. In addition to goods being damaged, there is much damage done to the actual packaging materials used to contain goods during the general handling and transportation phase whether in the pack-house, cold room, distribution centre, during delivery to retailers, during delivery to wholesalers and even during delivery to the end user. Container loads are being rejected due to packaging damage alone, even though the goods contained within the packaging might have escaped undamaged. The greater proportion of all damage is due to goods shifting on the pallet and either falling off the pallet or knocking against other palletised goods or objects as a result of having shifted. The present invention seeks at least in part to overcome some of these disadvantages.

SUMMARY OF THE INVENTION

A method of tying a load of packaged goods to a pallet according to the invention includes providing plates at the corners or the sides of the load, said plates being fitted with locking means for accepting adjusting straps, passing the adjusting straps through the locking means and tensioning the straps to hold the load together and securing the lower plates to the pallet.

The method further includes providing plates located at the centre of the sides and top of the load, said plates being fitted with locking means for accepting adjusting straps.

A method further includes providing plates at side corners of the load.

The locking means may be a swivel connector adapted to swivel on the plate to allow the locking means to line up with the direction of force in the adjusting strap.

The four top and four bottom plates may be provided with lifting locks.

The bottom plates may be adapted to be adjustably mounted on a pallet via sliding channel formations within the pallet and a corresponding sliding foot formation forming part of the plate so as to allow the plate to slide into the pallet and locate in any required position while forming a mechanical connection between the pallet and the plate.

Apparatus for use in the method according to the invention includes plates having swivel connectors, and adjusting straps suitable for use with the swivel connectors.

The invention also extends to a swivel connector for use in the method of the preceding claims in which there is a throat for accepting an adjusting strap, an internal ratchet to allow the strap to move in only one direction, and means for rotatably mounting the connector on a plate.

A bottom plate for use in the method according to the invention may have a sliding foot formation which corresponds to sliding channel formations in the pallet, the arrangement being such that the bottom plate can be adjustably located to accommodate different sized loads and secure both the bottom plate to the pallet and the load to the pallet.

The invention also extends to a pallet having sliding channel formations for receiving sliding foot formations on a bottom plate as previously described.

BRIEF DESCRIPTION OF THE DRAWINGS

The invention is now described, by way of non-limiting example, with reference to the accompanying drawings wherein.

DETAILED DESCRIPTION OF THE INVENTION

Figure 1:
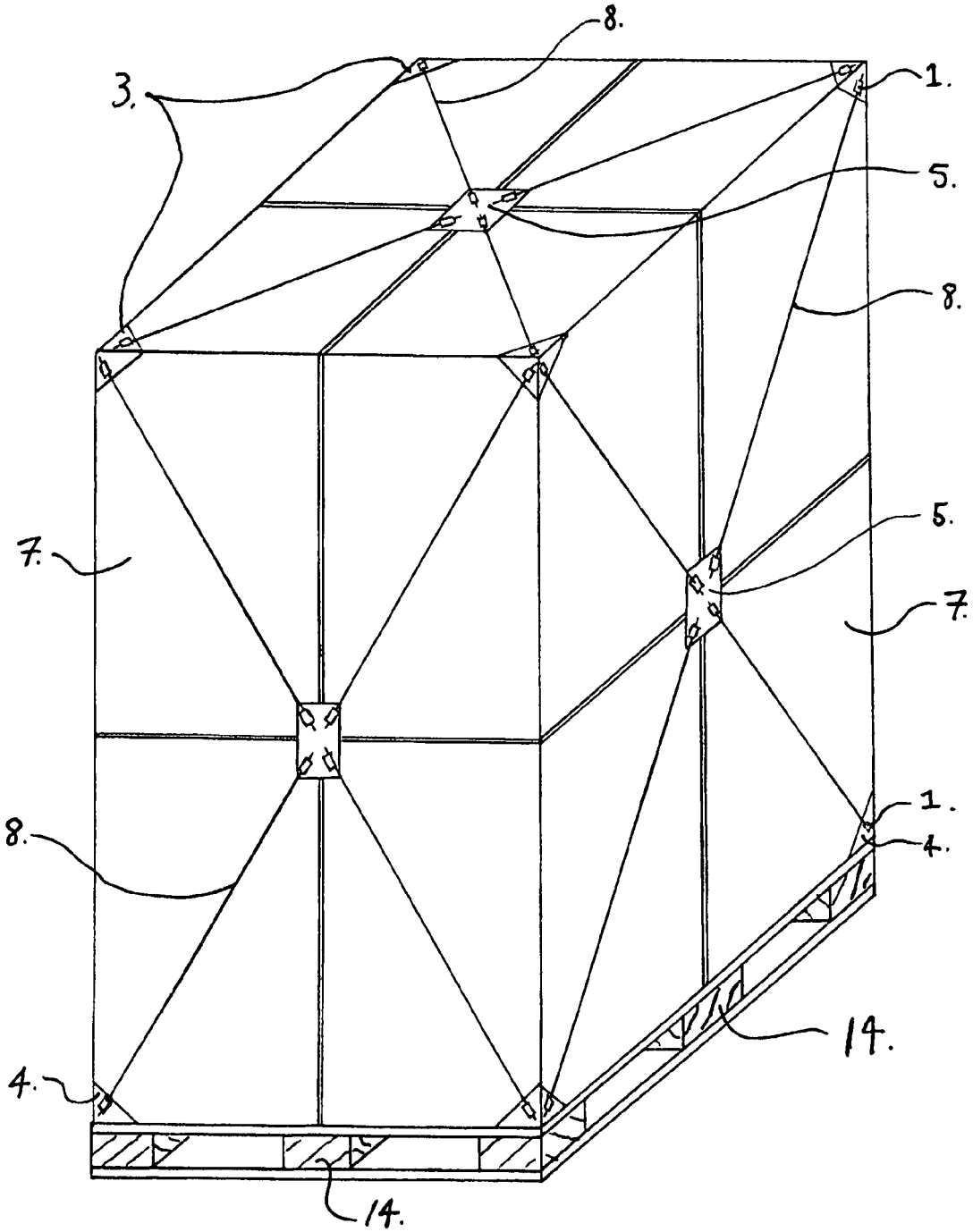
FIG. 1 shows a perspective view of a stack of packaged goods secured to a pallet using a method according to the invention.
Figure 2:
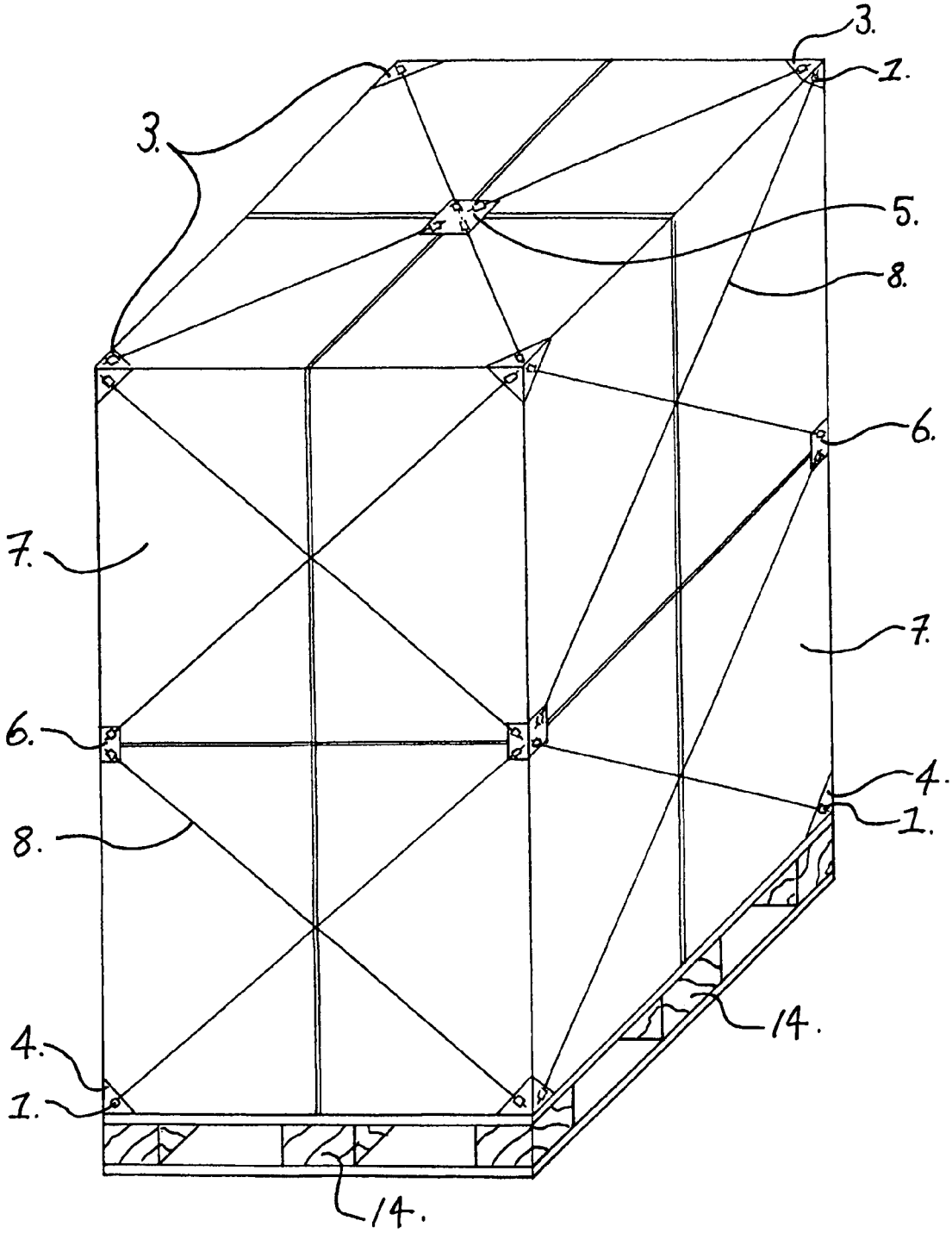
FIG. 2 shows a similar view to FIG. 1 but using another variation of the invention.
Figure 3:
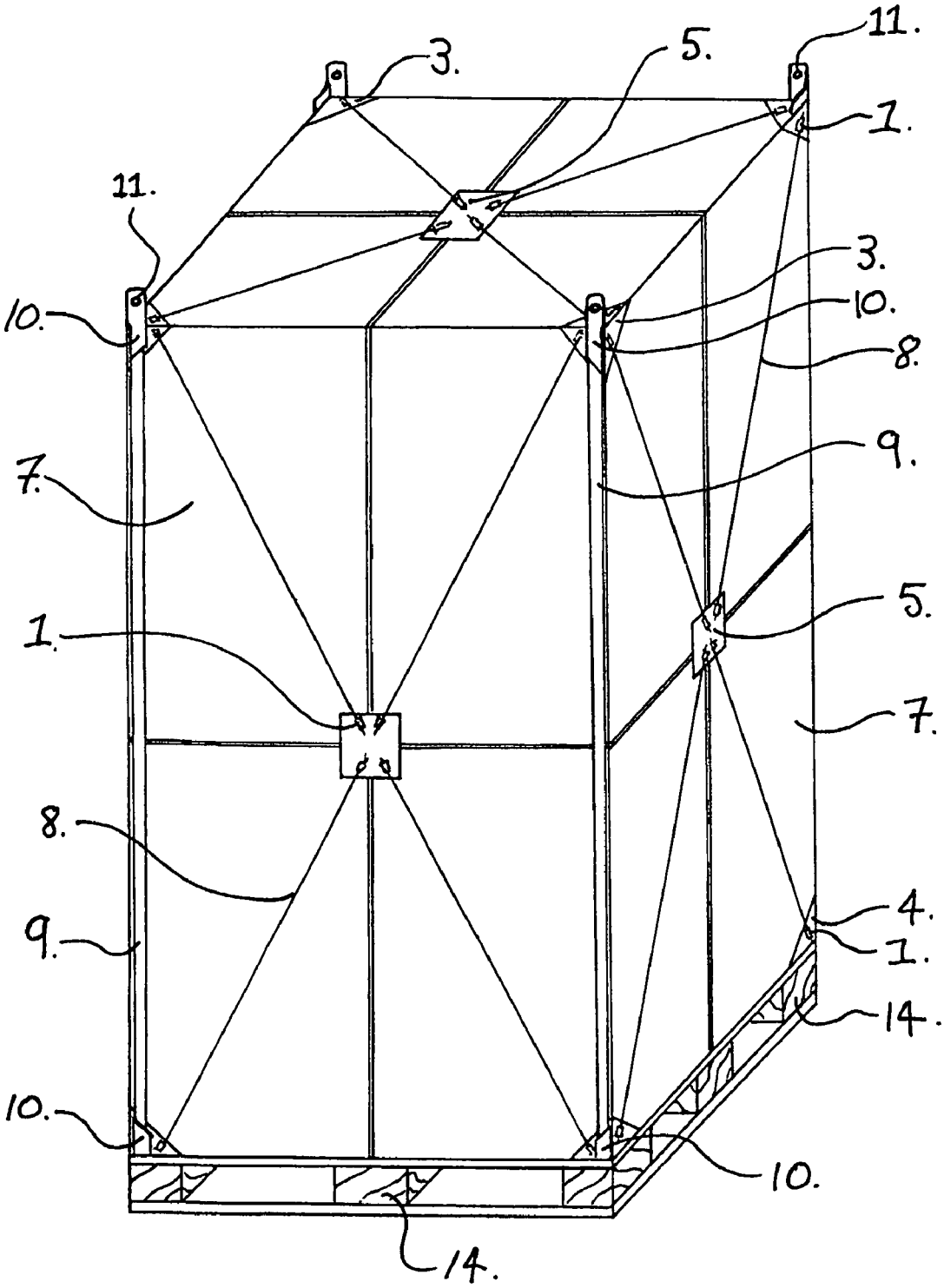
FIG. 3 shows a similar view to FIG. 1 but which includes means for top lifting of the palletized load.
Figure 5:
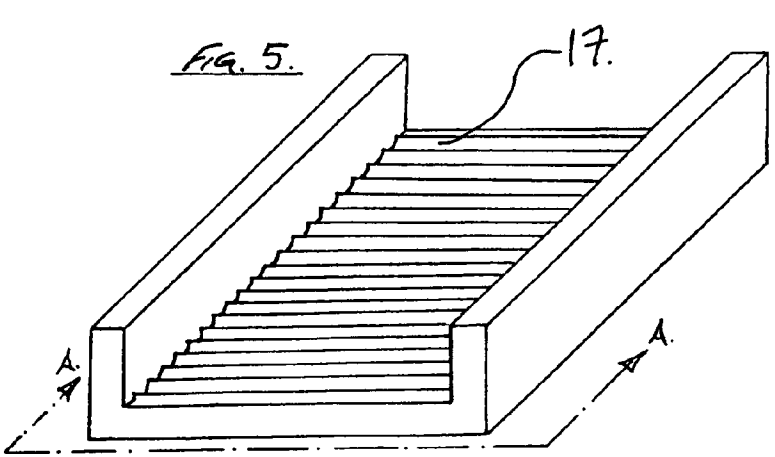
FIGS. 4, 5, 6 and 7 show different views of a swivel connector.
Figure 4:
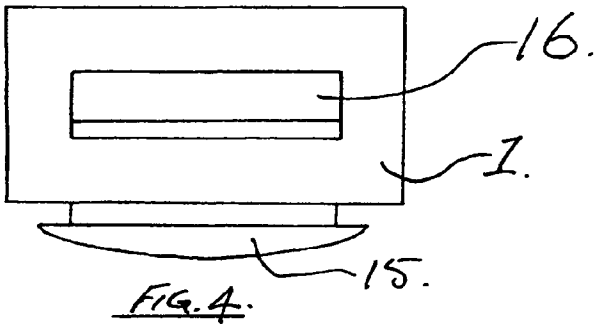
Figure 6:
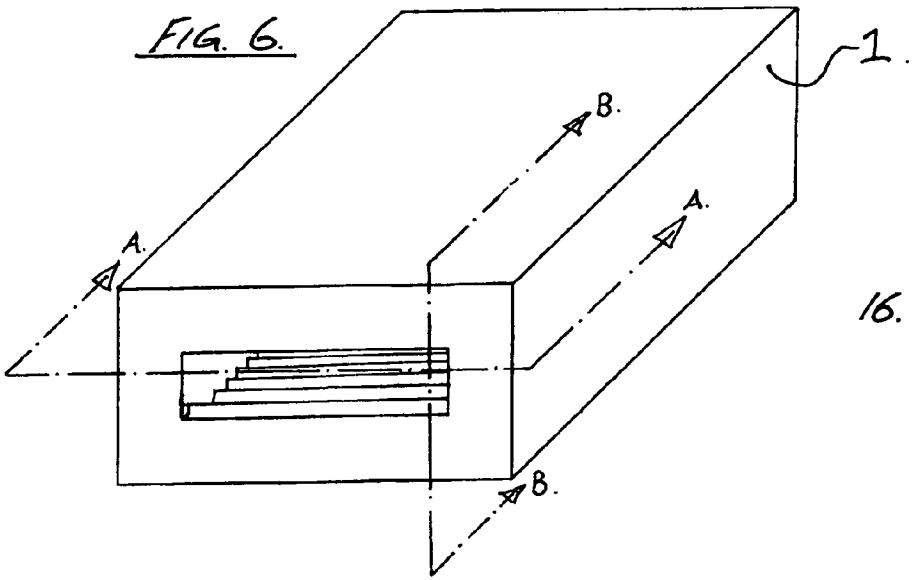
Figure 7:
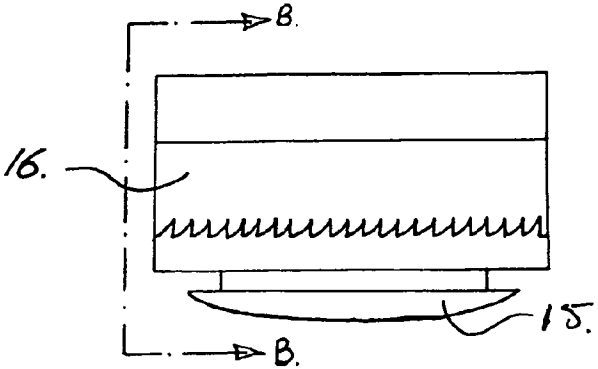

There are a number of configurations of the invention, three typical examples are shown in FIG. 1, FIG. 2 and FIG. 3 where with the use of method of the invention a load (7) is restrained from moving in a forward, sideways or vertical plane.

Referring to FIG. 1 the method makes use of four top corner plates (3), four bottom corner plates (4) and five centre plates (5). Each plate (3, 4 and 5) has a number of holes (2) that accept and retain swivel connectors (1) and adjustable connector straps (8) that mechanically connect the corner plates (3) and (4) and centre plates (5) and in this manner allow for the even restraining of the goods (7) packed on the pallet (14). It is possible to use a variation in size and shape of corner plates (3) and (4), centre plates (5) and adjustable connector straps (8) and in certain instances it might be possible to reposition or even eliminate the need for certain of these items in order to accommodate a variety of applications and at the same time contribute to the elimination of damage to the palletised load.

Referring to FIG. 2 there are four top corner plates (3), four bottom corner plates (4), four side corner plates (6) and one centre plate (5). Each have a number of holes (2) that accept and retain the swivel connectors (1) and adjustable connector straps (8) that mechanically connect the corner plates (3) and (4) and corner side plates (6) as well as the centre plate (5) and in this manner allow for the even restraining of the goods (7) packed on the pallet (14). It is possible to use a variation in size and shape of corner plates, corner side plates, centre plates and adjustable connector straps and in certain instances it might be possible to eliminate the need for certain of these items in order to accommodate a variety of applications and at the same time contribute to the elimination of damage to the palletised load.

FIG. 3 illustrates an example of the invention that allows for top lifting of the palletised load. Palletised goods are usually lifted at the base by means of a forklift or pallet-jack yet with a small adaptation of the four top corner plates and the bottom or base corner plates to accept an adjustable lifting strap, it is possible to lift the entire palletised load from the top via an overhead crane or other top-lift equipment and this allows for much improved goods handling possibilities both in time saved and reduced damage.

Figure 16:
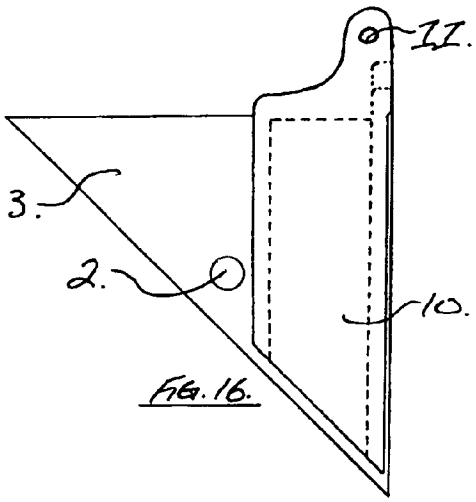
FIGS. 14, 15 and 16 show a top loading top corner plate with lifting lock and lifting eye.
Figure 15:
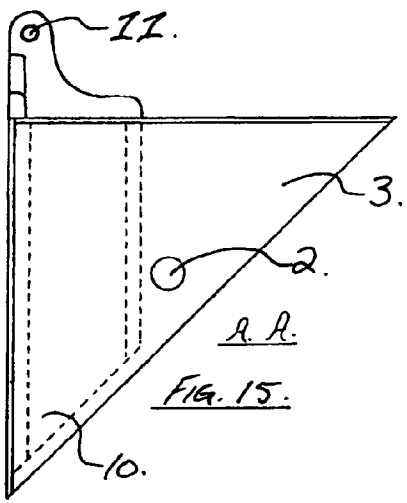
Figure 14:
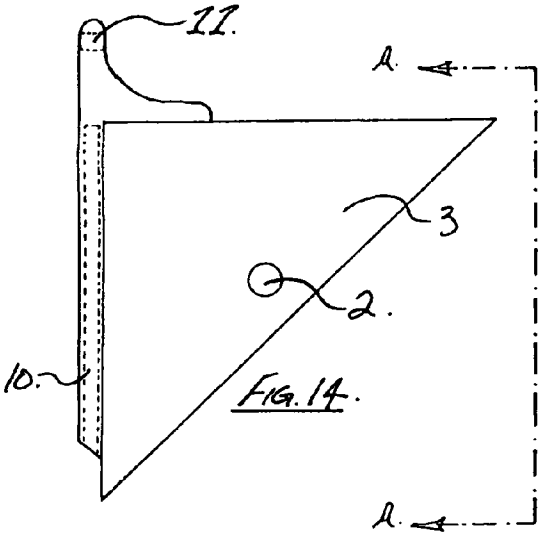
Figure 19:
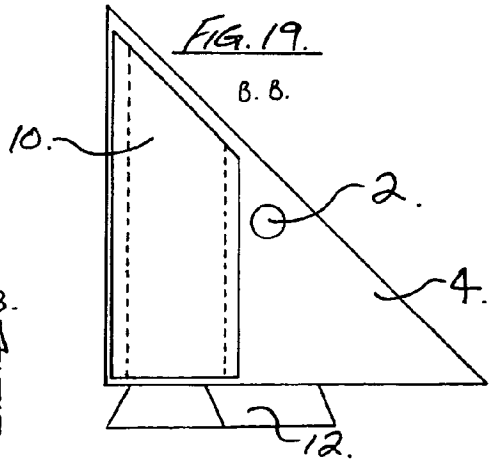
FIGS. 17, 18 and 19 show a bottom or base corner plate with a lifting lock and sliding mechanism.
Figure 18:
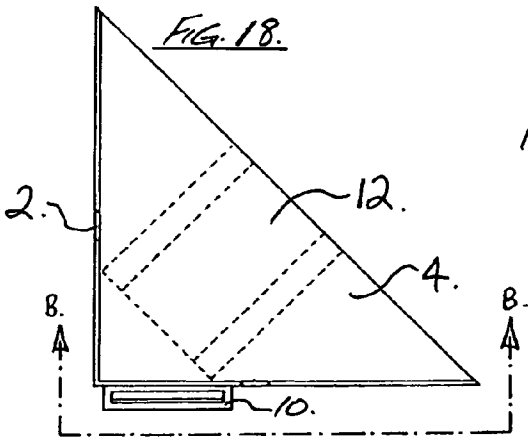
Figure 17:
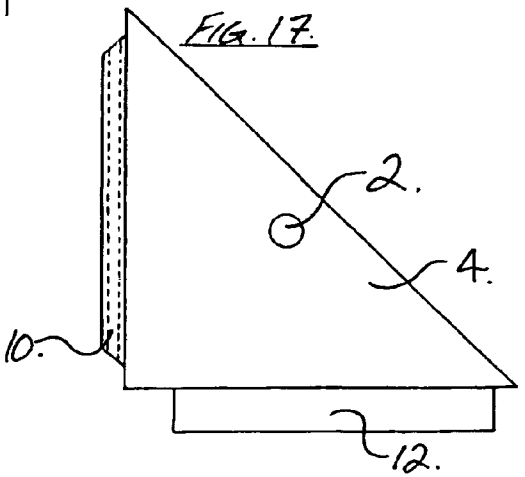

FIG. 3 shows a top corner plate (3) with lifting eye (11) and built in lifting lock (10) containing an internal one-way locking ratchet that will accept an adjustable lifting strap (9) as shown in FIGS. 14, 15 and 16. The bottom or base corner plate (4) has a built-in lifting lock (10) containing internal one-way locking ratchets that will accept an adjustable lifting strap (9) as shown in FIGS. 17, 18 and 19.

Figure 9:
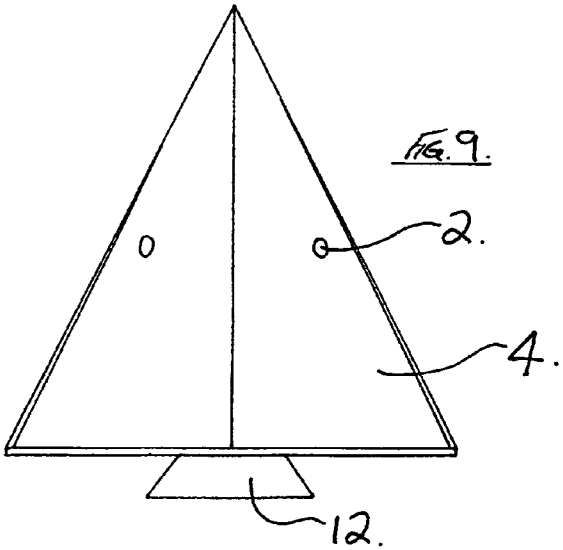
FIGS. 8, 9 and 10 show different views of an adjustable base corner plate.
Figure 8:
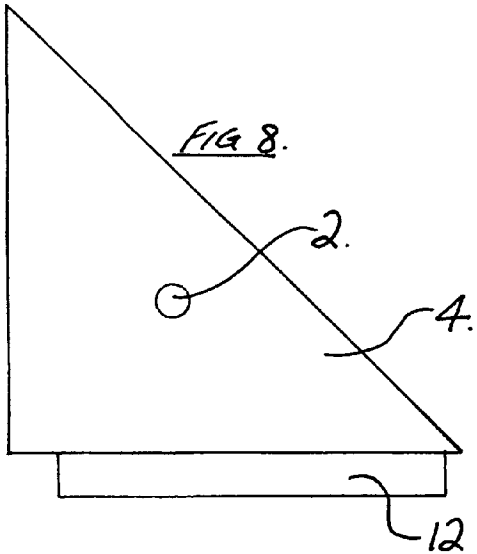
Figure 10:
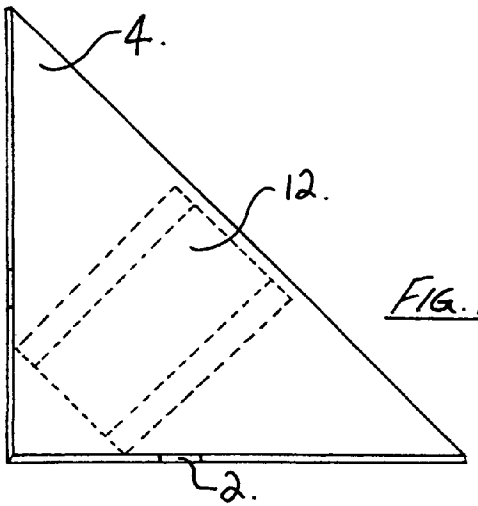
Figure 20:
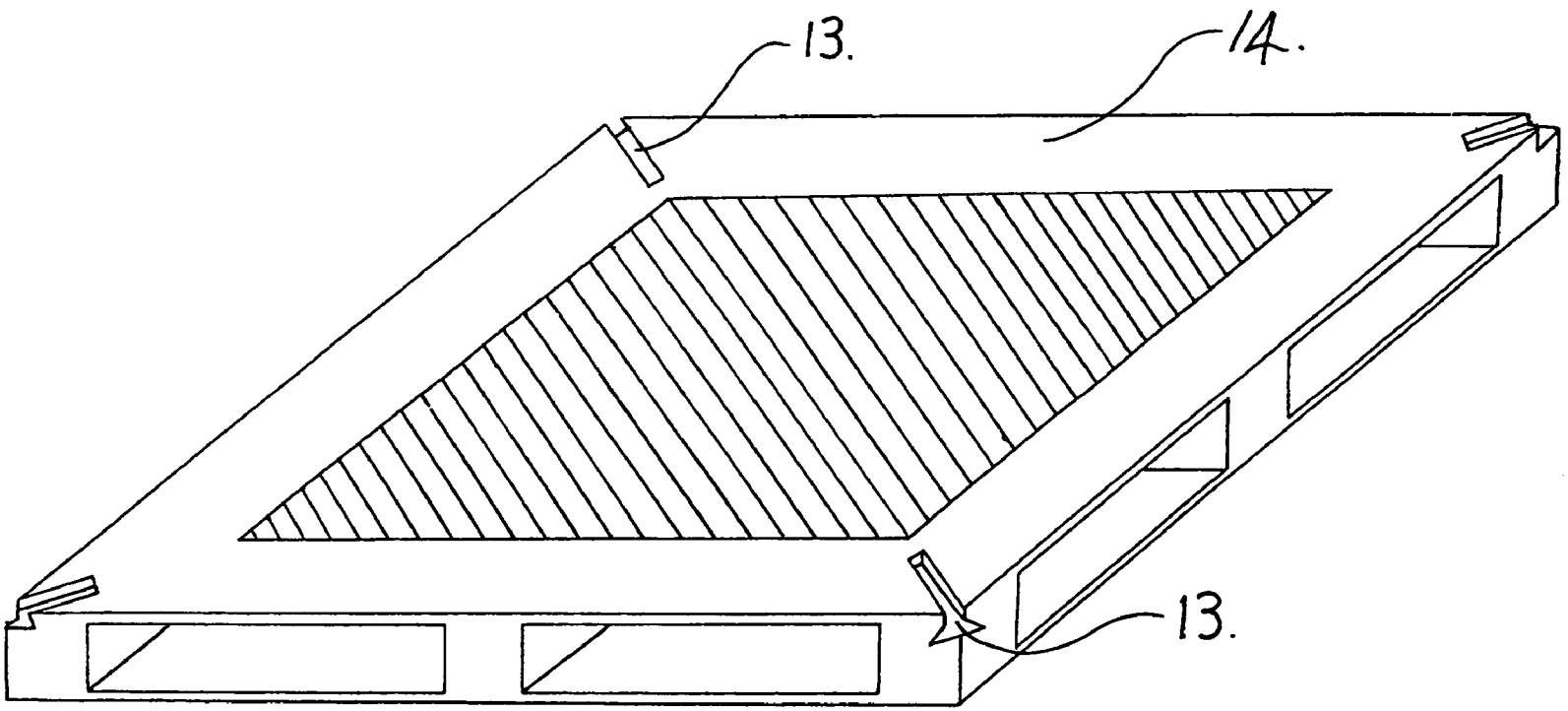
FIG. 20 shows a pallet with integral locating sliding mechanism.

The bottom or base corner plate (4) also has an adjustable sliding foot (12) as shown in FIGS. 8, 9 and 10 which slides in a runner (13) forming part of the pallet (14) as shown in FIG. 20. This creates a mechanical connection between the bottom corner plate (4) and the pallet (14) and the top corner plate (3) and as such the entire load being goods (7) and pallet (14) can be safely lifted from the top as one unit.

FIGS. 4, 5, 6 and 7 illustrate a typical design for a swivel connector (1) as used in the invention. Swivel connector (1) is fitted to the corner plates (3) and (4), side plates (6) and centre plates (5) using holes (2). The swivel connector (1) has a stud (15) that pushes through holes (2) in the corner, centre and side plates and a throat (16) for accepting connector straps (8). The swivel connector (1) is able to rotate to take up any variance in angle so that the pull or tension applied by the adjustable connector straps (8) is always in a straight line. This ensures maximum tension is applied with the least amount of give or stretch. The swivel connector (1) accepts the adjustable connector straps (8) and an internal ratchet (17) allows the adjustable connector straps (8) to slide through in one direction only thus allowing for pre-tensioning of the loaded goods (7) that are in turn mechanically connected to the pallet (14) via the sliding foot mechanism (12) of bottom corner plates (4). It is possible for the swivel connector (1) to be manufactured in various shapes and sizes to accommodate a variety of applications.

FIGS. 8, 9 and 10 illustrate a typical example of an adjustable bottom or base corner plate (4). Corner plate (4) has a male foot (12) which slides within an integral corresponding female runner (13) forming part of the pallet (14) as shown in FIG. 20 and in doing so, the foot (12) creates a mechanical connection between the corner plate (4) and the angled runner (13) within pallet (14). This allows for any configuration (footprint) of loaded goods to be accommodated. The bottom or base corner plate (4) may be manufactured in various shapes and sizes to accommodate a variety of applications (such as top lifting of the pallet) and the male foot (12) and corresponding female runner (13) within the pallet (14) may vary in position, shape (round, square, rectangular, triangular etc) and also size to accommodate a variety of applications.

Figure 12:
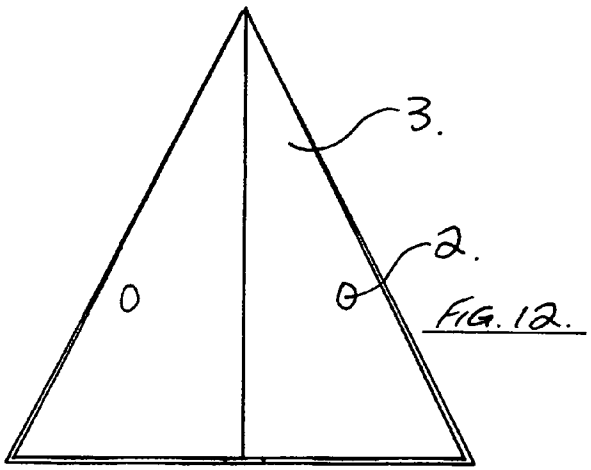
FIGS. 11, 12 and 13 show different views of a top corner plate.
Figure 11:
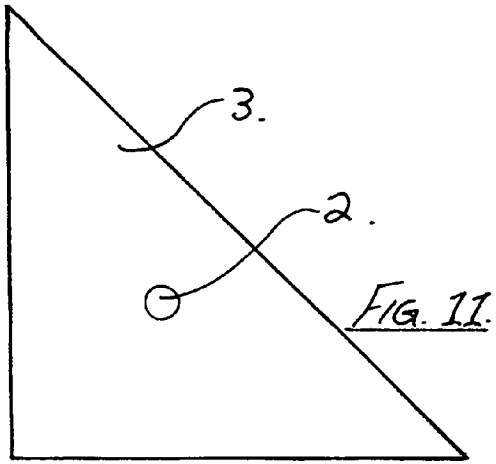
Figure 13:
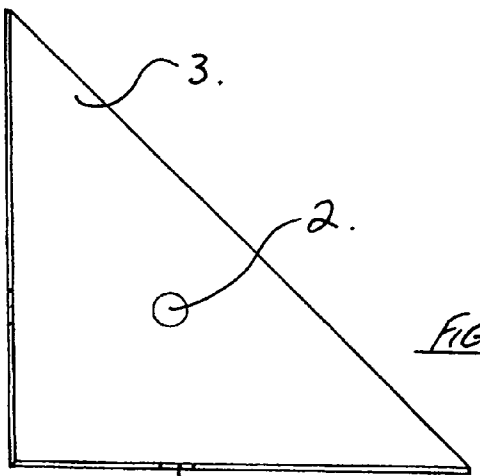

FIGS. 11, 12 and 13 illustrate an example of a standard corner plate (3) that can be used as a top corner plate as well as a bottom or base corner plate by simply fixing a standard corner plate (3) to the pallet (14) by means of nailing, screwing, clamping or other available means. The standard corner plate (3) will accommodate any pallet made of any material irrespective of pallet size and can be manufactured in various shapes and sizes to accommodate a variety of applications.

FIGS. 14, 15 and 16 illustrate an example of a purpose built top loading top corner plate (3) with a built in lifting lock (10) and lifting eye (11).

FIGS. 17, 18 and 19 illustrate a bottom or base corner plate (4) with built in lifting lock (10) and sliding foot mechanism (12) that provides both footprint adjustment to accommodate any load configuration and also mechanical connection of the bottom or base corner plate (4) to the pallet (14). It is possible for the bottom or base corner plate (4) and the top corner plate (3) to be manufactured in various shapes and sizes to accommodate a variety of applications.

FIG. 20 illustrates an example of a pallet (14) with integral female locating sliding mechanism (13) that corresponds to and accepts the foot (12) of base corner plate (4).

Figure 22:
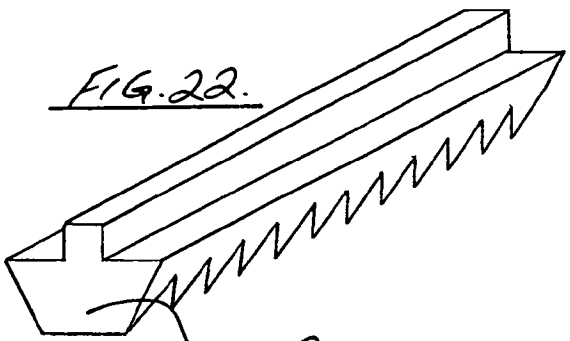
FIGS. 21, 22 and 23 show typical sliding corner plate foot variations with the addition of optional single directional self-locking mechanism.
Figure 21:
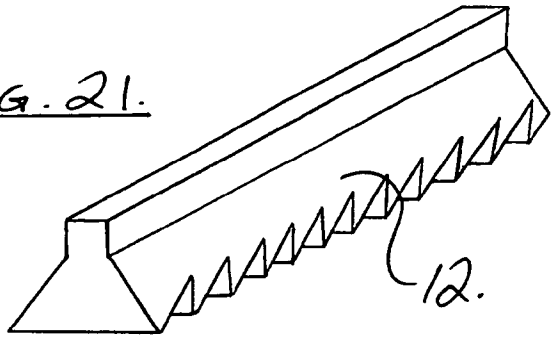
Figure 23:
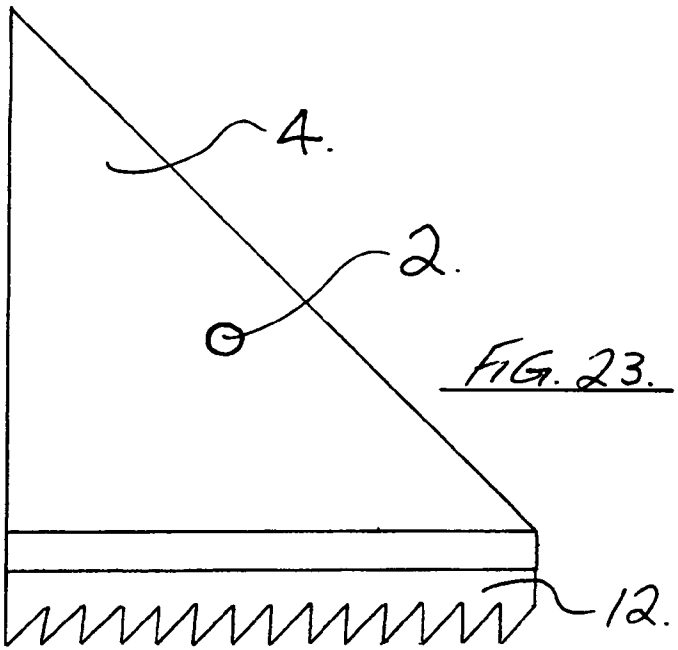

FIGS. 21 and 22 illustrate variations on the male locating sliding foot arrangement (12) that form part of the bottom corner plate (4) and FIG. 23 illustrates a side view of a complete bottom corner plate (4) with one variation of a male locating slide foot mechanism (12) that is single directional and self locking within the pallet (14).

Method of Assembly as in FIG. 1

The method of assembly as shown in FIG. 1 will now be described.

The swivel connectors (1) are fitted to the holes (2) provided in the four top corner plates (3) and the four bottom or base corner plates (4) as well the five centre plates (5), the male locating sliding foot mechanism (12) that forms part of the four bottom or base corner plates (4) are slid into the integral female locating sliding mechanism (13) that forms part of the pallet (14) creating a mechanical bond between the four bottom or base corner plates (4) and the pallet (14). The bottom or base corner plates (4) are spaced so as to accommodate the footprint of the intended packaged goods (7). The goods (7) are then positioned on the pallet (14) and packed to the full height. The four top corner plates (3) are each now positioned to cover a top corner of the packaged goods (7) and an adjustable connector strap (8) is fed through each of the swivel connectors (1) attached to the top of the top corner plates (3). These same adjustable connector straps (8) are now fed, one each, through the four swivel connectors (1) attached to the top centre plate (5) and pulled through until a light tension is applied thus creating a mechanical connection between the top corner plates (3) and the top centre plate (5), adjustable connector straps (8) are fed through the swivel connectors (1) attached to the eight sides of the top corner plates (3). These same adjustable connector straps (8) are now fed through the swivel connectors (1) attached to the top of the four side centre plates (5) and pulled through until a light tension is applied thus creating a mechanical connection between the top corner plates (3) and the top of the side centre plates (5), adjustable connector straps (8) are fed through the swivel connectors (1) attached to the eight sides of the bottom corner plates (4). These same adjustable connector straps (8) are now fed through the swivel connectors (1) attached to the bottom of the four side centre plates (5) and pulled through until a light tension is applied thus creating a mechanical connection between the bottom or base corner plates (4) and the bottom of the side centre plates (5). Tension is now evenly applied to the loaded goods (7) by pulling and tensioning each of the adjustable connector straps (8) and in this manner the entire load is firmly held to the pallet (14) and prevented from shifting in a forward, side-ward or vertical plane.

Method of Assembly as in FIG. 2

The method of assembly as shown in FIG. 2 will now be described.

The swivel connectors (1) are fitted to the holes (2) provided in the four top corner plates (3), the four bottom or base corner plates (4), the single centre plate (5) and the four corner side plates (6), the male locating sliding foot mechanism (12) that forms part of the four bottom or base corner plates (4) are slid into the integral female locating sliding mechanism (13) that forms part of the pallet (14) creating a mechanical bond between the four bottom or base corner plates (4) and the pallet (14). The bottom or base corner plates (4) are spaced so as to accommodate the footprint of the intended packaged goods (7). The goods (7) are then positioned on the pallet (14) and packed to the full height, the four top corner plates (3) are each now positioned to cover a top corner of the packaged goods (7) and an adjustable connector strap (8) is fed through each of the swivel connectors (1) attached to the top of the top corner plates (3), these same adjustable connector straps (8) are now fed, one each, through the four swivel connectors (1) attached to the top centre plate (5) and pulled through until a light tension is applied thus creating a mechanical connection between the top corner plates (3) and the top centre plate (5), adjustable connector straps (8) are fed through the swivel connectors (1) attached to the eight sides of the top corner plates (3) these same adjustable connector straps (8) are now fed through the swivel connectors (1) attached to the top of the four side plates (6) and pulled through until a light tension is applied thus creating a mechanical connection between the top corner plates (3) and the top of the side plates (6), adjustable connector straps (8) are fed through the swivel connectors (1) attached to the eight sides of the bottom corner plates (4) these same adjustable connector straps (8) are now fed through the swivel connectors (1) attached to the bottom of the four side plates (6) and pulled through until a light tension is applied thus creating a mechanical connection between the bottom or base corner plates (4) and the bottom of the side plates (6), tension is now evenly applied to the loaded goods (7) by pulling and tensioning each of the adjustable connector straps (8) and in this manner the entire load is firmly held to the pallet (14) and prevented from shifting in a forward, side-ward or vertical plane.

Method of Assembly as in FIG. 3

The method of assembly as shown in FIG. 3 will now be described.

The swivel connectors (1) are fitted to the holes (2) provided in the four top corner plates (3), the bottom corner plates (4) and the five centre plates (5). The bottom corner plates (4) include the sliding mechanism (12) shown in FIGS. 17, 18 and 19. The male locating sliding foot mechanism (12) that forms part of the four bottom or base corner plates (4) are slid into the integral female locating sliding mechanism (13) that forms part of the pallet (14) creating a mechanical bond between the four bottom or base corner plates (4) and the pallet (14). The bottom or base corner plates (4) are spaced so as to accommodate the footprint of the intended packaged goods (7). The goods (7) are then positioned on the pallet (14) and packed to the full height, the four top corner plates (3) are each now positioned to cover a top corner of the goods (7) and an adjustable connector strap (8) is fed through each of the swivel connectors (1) attached to the top of the top corner plates (3). These same adjustable connector straps (8) are now fed, one each, through the four swivel connectors (1) attached to the top centre plate (5) and pulled through until a light tension is applied thus creating a mechanical connection between the top corner plates (3) and the centre plate (5), further adjustable connector straps (8) are fed through the swivel connectors (1) attached to the eight sides of the top corner plates (3) these same adjustable connector straps (8) are now fed through the swivel connectors (1) attached to the top of the four side centre plates (5) and pulled through until a light tension is applied thus creating a mechanical connection between the top corner plates (3) and the top of the side centre plates (5). Adjustable connector straps (8) are fed through the swivel connectors (1) attached to the eight sides of the bottom corner plates (4) these same adjustable connector straps (8) are now fed through the swivel connectors (1) attached to the bottom of the four side centre plates (5) and pulled through until a light tension is applied thus creating a mechanical connection between the bottom corner plates (4) and the bottom of the side centre plates (5), tension is now evenly applied to the loaded goods (7) by pulling and tensioning each of the adjustable connector straps (8) and in this manner the entire load is firmly held to the pallet (14). This prevents the load from shifting in a forward, side-ward or vertical plane.

Adjustable lifting straps (9) are now fed through the four lifting locks (10) which are an integral part of the four bottom corner plates (4). These same adjustable lifting straps (9) are now fed through the four lifting locks (10) which are an integral part of the four top corner plates (3) and the adjustable lifting straps (9) are fully tensioned. Should the load need to be lifted from the top, the four lifting eyes (11) that form part of the top corner plates (3) are now connected to the crane or top lifting vehicle by means of chain and shackle or any other appropriate means and the entire load inclusive of the pallet (14) can now be lifted from above and placed or stacked in a different position. The full weight of the load, that is pallet (14) and goods (7), is now carried on the four adjustable lifting straps (9).

The components of the invention inclusive of the pallet (14) can be manufactured from a variety of materials although the intention is to use materials that are able to be recycled.

INDUSTRIAL APPLICATION

The invention has industrial application in that it will be applied to the transport of packaged goods on pallets.

The invention claimed is:

1. A method of tying a load of packaged goods to a pallet, said method including:

providing plates at corners or sides of the load, said plates being fitted with locking means for accepting adjusting straps, said plates being adapted to be adjustably mounted on said pallet via sliding channel formations within the pallet and corresponding sliding foot formations forming part of the plates;

allowing at least one of said plates to slide along one of said sliding channel formations relative to the pallet;

locating said plates in desired positions relative to the pallet by forming mechanical connections between the pallet and the plates;

passing the adjusting straps through the locking means and tensioning the straps to hold the load together; and securing lower plates to the pallet.

2. A method according to claim 1, which includes providing said plates fitted with the locking means at sides of the load.

3. A method according to claim 1, which includes providing said plates fitted with the locking means at corners of the load.

4. A method according to claim 1, in which the locking means includes a swivel connector adapted to swivel on one of the plates fitted with the locking means to allow one of the straps, when passed through the locking means, to line up with a direction of force in the strap.

5. A method according to claim 1 in which four top and four bottom plates of the load are provided with lifting locks.

6. A method according to claim 2, in which the locking means includes a swivel connector adapted to swivel on one of the plates fitted with the locking means to allow one of the straps, when passed through the locking means, to line up with a direction of force in the strap.

7. A method according to claim 3, in which the locking means is includes a swivel connector adapted to swivel on one of the plates fitted with the locking means to allow one of the straps, when passed through the locking means, to line up with a direction of force in the strap.

* * * * *